US010284945B2

(12) United States Patent
Christensen

(10) Patent No.: US 10,284,945 B2
(45) Date of Patent: May 7, 2019

(54) AIR MOTION TRANSFORMER PASSIVE RADIATOR FOR LOUDSPEAKER

(71) Applicant: Eugene Julius Christensen, Aspen, CO (US)

(72) Inventor: Eugene Julius Christensen, Aspen, CO (US)

( * ) Notice: Subject to any disclaimer, the term of this patent is extended or adjusted under 35 U.S.C. 154(b) by 0 days.

(21) Appl. No.: 15/530,087

(22) Filed: Nov. 30, 2016

(65) Prior Publication Data

US 2018/0152782 A1 May 31, 2018

(51) Int. Cl.
*H04R 25/00* (2006.01)
*H04R 1/28* (2006.01)
*H04R 9/06* (2006.01)

(52) U.S. Cl.
CPC ..... *H04R 1/2834* (2013.01); *H04R 9/06* (2013.01)

(58) Field of Classification Search
CPC ..... H04R 1/2834; H04R 7/26; H04R 9/06; H04R 1/283
USPC ..... 381/152, 335, 342, 345, 349, 386, 408, 381/418, 423, 86; 181/144, 147, 181/155–157, 160; D14/204
See application file for complete search history.

(56) References Cited

U.S. PATENT DOCUMENTS 1,849,840 A * 3/1932 Kellogg ..... G10K 11/025 181/187
2,493,734 A * 1/1950 Pearson ..... H04R 11/06 381/328
2,975,307 A * 3/1961 Schroeder ..... H01H 59/00 29/596
3,636,278 A * 1/1972 Heil ..... H04R 7/14 381/163
3,690,405 A * 9/1972 Hance ..... H04R 1/2819 181/155
3,824,343 A * 7/1974 Dahlquist ..... H04R 1/26 181/147
4,039,044 A * 8/1977 Heil ..... H04R 1/02 181/144
4,054,748 A * 10/1977 Balogh ..... H04R 1/347 181/199
4,056,697 A * 11/1977 Heil ..... H04R 7/14 181/164
4,076,097 A * 2/1978 Clarke ..... H04R 1/2834 181/147
4,107,479 A * 8/1978 Heil ..... H04R 1/34 181/155
4,119,799 A * 10/1978 Merlino ..... H04R 1/403 181/144
4,128,738 A * 12/1978 Gallery ..... H04R 1/2819 181/146
4,284,844 A * 8/1981 Belles ..... H04R 1/2834 181/151

(Continued)

*Primary Examiner* — Phylesha Dabney
(74) *Attorney, Agent, or Firm* — Patterson Intellectual Property Law, P.C.; Jerry Turner Sewell

(57) ABSTRACT

The present invention provides an improved passive radiator device by utilizing a stacked construction in which there exist two or more generally parallel and separate movable diaphragm sections, in which the relative motion of adjacent diaphragm sections will either move toward each other, or away from each other, as air pressure or sound waves emanating from the interior of a loudspeaker cabinet impinges upon the interior air openings of the present invention.

13 Claims, 16 Drawing Sheets

(56) References Cited

U.S. PATENT DOCUMENTS 4,354,066 A * 10/1982 Necoechea ..... H04R 7/045 181/173
4,544,805 A * 10/1985 Sawafuji ..... H04R 9/063 181/173
4,714,133 A * 12/1987 Skaggs, Jr. ..... G10K 11/08 181/148
4,850,452 A * 7/1989 Wolcott ..... H04R 1/2865 181/144
5,588,063 A * 12/1996 Edgar ..... G06F 1/1605 381/182
5,742,690 A * 4/1998 Edgar ..... G06F 1/1605 381/300
5,749,433 A * 5/1998 Jackson ..... H04R 1/2834 181/156
5,809,154 A * 9/1998 Polk ..... H04R 1/2826 181/156
5,821,471 A * 10/1998 McCuller ..... H04M 1/035 181/156
5,841,877 A * 11/1998 Mihara ..... H04R 5/023 381/86
5,940,347 A * 8/1999 Raida ..... G10K 11/24 367/138
6,044,925 A * 4/2000 Sahyoun ..... H04R 1/2834 181/157
6,169,809 B1 * 1/2001 Azima ..... G06F 1/1616 381/152
6,169,811 B1 * 1/2001 Croft, III ..... H04R 1/2842 181/144
D567,213 S * 4/2008 Prince ..... D14/204
D567,214 S * 4/2008 Fynboe ..... D14/204
8,208,678 B2 * 6/2012 Mundorf ..... H04R 9/048 381/190
8,897,472 B2 * 11/2014 Unruh ..... H04R 9/063 381/186
9,462,388 B2 * 10/2016 Unruh ..... H04R 7/08
9,674,594 B2 * 6/2017 Li ..... H04R 1/026
9,900,696 B2 * 2/2018 Christensen ..... H04R 7/122
2001/0017927 A1 * 8/2001 Bachmann ..... H04R 1/2819 381/395
2002/0121403 A1 * 9/2002 Sahyoun ..... H04R 7/20 181/157
2003/0228027 A1 * 12/2003 Czerwinski ..... H04R 1/26 381/342
2004/0188175 A1 * 9/2004 Sahyoun ..... H04R 7/122 181/157
2004/0195039 A1 * 10/2004 Sahyoun ..... H04R 7/122 181/157
2015/0036867 A1 * 2/2015 Unruh ..... H04R 9/063 381/398
2015/0036868 A1 * 2/2015 Unruh ..... H04R 7/08 381/398
2015/0104057 A1 * 4/2015 Li ..... H04R 1/2896 381/386
2016/0094909 A1 * 3/2016 Johnston ..... H04R 1/2834 381/186
2018/0077486 A1 * 3/2018 Li ..... H04R 1/2834

* cited by examiner

16
View
10
1

2

16
View
10
1
15
15
2

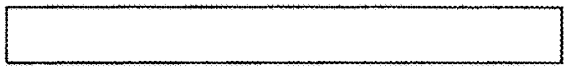
FIG. 8D
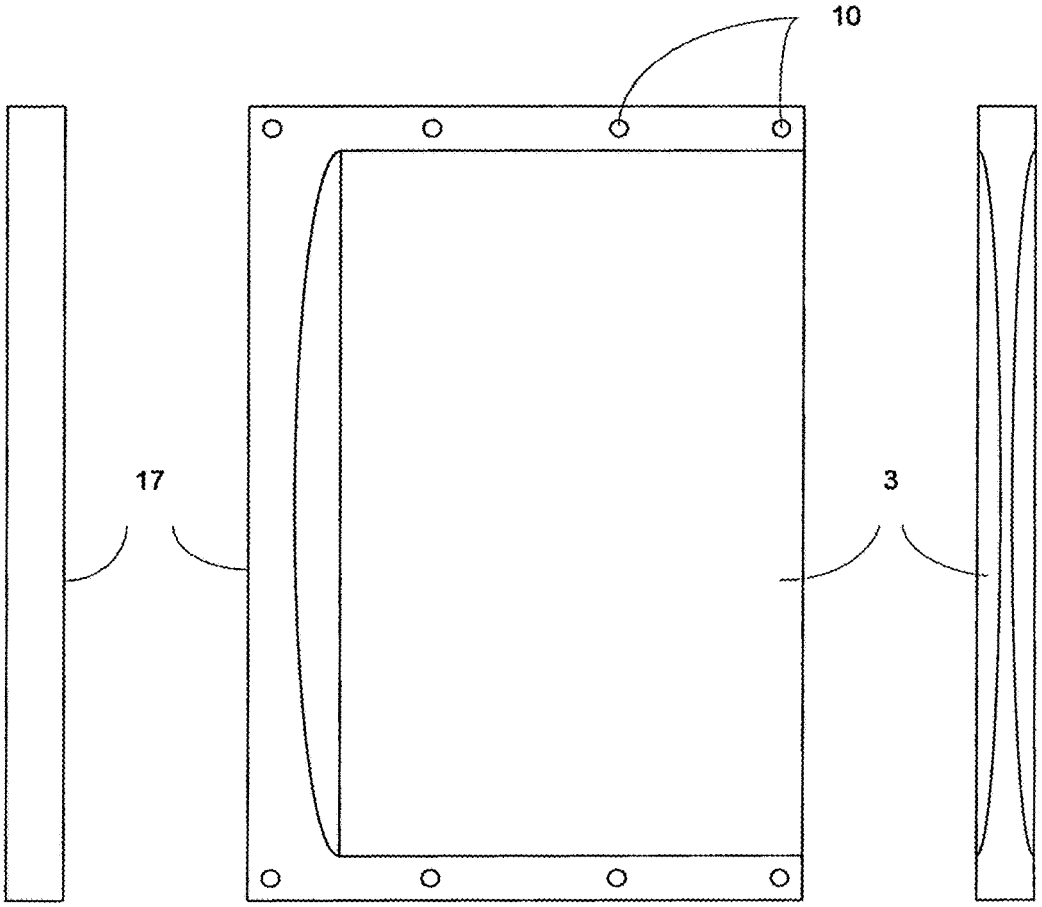
FIG. 8A
FIG. 8C
FIG. 8E
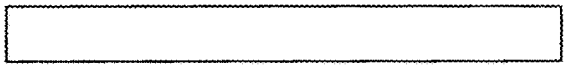
FIG. 8B

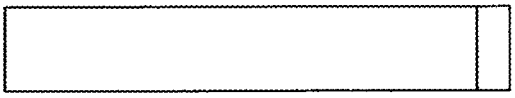
FIG. 12D
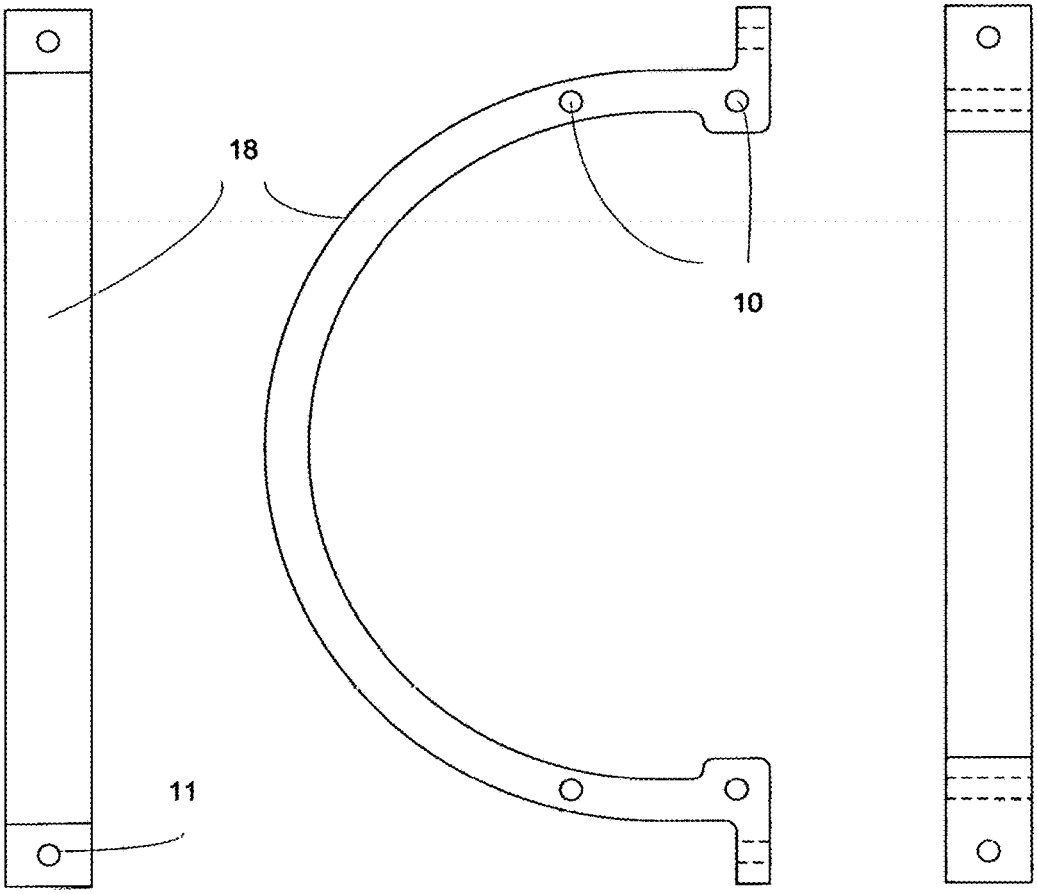
FIG. 12A
FIG. 12C
FIG. 12E
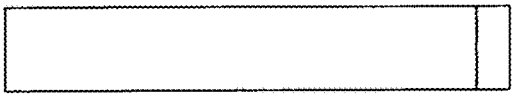
FIG. 12B

AIR MOTION TRANSFORMER PASSIVE RADIATOR FOR LOUDSPEAKER

CROSS-REFERENCE TO RELATED APPLICATIONS

This application claims priority for U.S. Provisional Patent Application 62/386,474 dated Dec. 3, 2015 and US Provisional Patent Application 62/387,109 dated Dec. 23, 2015.

BACKGROUND OF THE INVENTION

Field of the Invention

This invention relates generally to loudspeaker passive radiator devices.

Description of Related Art

Conventional loudspeaker passive radiator devices, sometimes also known as 'drone cones', have been available for many decades, at least as far back as 1954, as mentioned in the Journal of the Audio Engineering Society, (Vol. II, No. 4, p. 219), Harry F. Olson, et al. The purpose and function of a passive radiator is to provide passive means for extending the low-frequency response of a loudspeaker system through the resonant motion of a suspended, movable panel or surface which has the appropriate mass and spring constant properties to correctly interact with the desired low frequencies of sound waves emanating from the interior of a loudspeaker cabinet, which are generated by an active woofer driver located in the same loudspeaker cabinet as the passive radiator device.

Typically, conventional passive radiators are constructed in a similar way as are traditional moving-coil/cone woofers, except that conventional passive radiators usually omit the magnet motor assembly and wire voice coil components of a conventional woofer. Conventional passive radiators typically also include means for adding or removing additional weights, which may be fixedly attached to the moving diaphragm surfaces in order to adjust the resonant frequency characteristics of the passive radiator.

One of the main drawbacks of conventional passive radiators is that the single moving diaphragm of a conventional passive radiator must be made very large, or must have a large amount of linear travel available, or must have both, in order to provide low-distortion, low-frequency sound. This implies that a conventional passive radiator will occupy a large amount of surface area when mounted on the surface of a loudspeaker cabinet, and this large area requirement restricts the available areas where a conventional passive radiator may be mounted on a loudspeaker cabinet. Another drawback of conventional passive radiators is that large amounts of mechanical vibration are passed onto the loudspeaker cabinet through the passive radiator frame as the moving parts of the passive radiator vibrate back and forth. A third drawback of conventional passive radiators is the large amount of linear travel typically required, resulting in unwanted, distorted modes of movement such as rocking and non-linear motion at the extremes of excursion.

BRIEF SUMMARY OF THE INVENTION

The present invention greatly improves upon conventional passive radiator technology by utilizing a stacked, 'air motion transformer'-like construction, in which there exist two or more generally parallel and separate moving diaphragm sections, in which the relative motion of adjacent diaphragm sections will either move toward each other, or away from each other, as air pressure or sound waves emanating from the interior of a loudspeaker cabinet impinges upon the interior air openings of the present invention. In a variation of the present invention, magnetic sections may be attached to the various moving components of the passive radiator device which may provide part or all of the suspension of the moving components, and which may also act to limit over-excursion of the moving components at high output levels.

In U.S. Pat. No. 3,636,278 inventor Oskar Heil described a type of high-frequency, actively powered loudspeaker driver generally known to those skilled in the art as an 'air motion transformer' driver, in which sound is produced through the operation of a layered or folded diaphragm operated in such a way that adjacent moving portions of the diaphragm assemblies will always move either away from each other, or toward each other, depending on the direction of electric current flow in conductors attached to the moving diaphragm sections. This high-frequency, actively powered 'air motion transformer' principle can be adapted and modified, through several inventive steps and in non-obvious ways to those generally skilled in the art, to be utilized in passively-operated, low-frequency 'air motion transformer' devices which are not anticipated by prior art, with the additional inventive step of utilizing the air masses which have been trapped between adjacent diaphragm sections as part of the total moving mass, and also through the inventive step of adding optional magnetic suspension elements, which result in the present invention passive radiator device exhibiting lower distortion, greater ultimate sound pressure capability, much lower external vibration, a smaller form factor and the same or lower total cost than traditional, conventional passive radiator devices.

BRIEF DESCRIPTION OF THE DRAWINGS

FIG. 8 shows the external front view of a separator panel for an alternative embodiment of the passive radiator device. FIG. 8B thru 8E are the bottom, left side, top and right side external views respectively of FIG. 8A.

FIG. 12A shows the external view of a rear-opening separator member for an arcuate-shaped alternative embodiment of the passive radiator device shown in FIG. 13 thru FIG. 16. FIG. 12B thru 12E are the bottom, left side, top and right side external views respectively of FIG. 12A.

DETAILED DESCRIPTION OF THE INVENTION

This invention relates to a device which can be used to augment the production of low frequency sounds emanating from a loudspeaker cabinet 14 which also contains one or more low frequency active drivers such as a conventional moving coil and cone woofer 12.

The moving diaphragms or diaphragm sections of the present invention are arranged in generally parallel coaxial layers, with semi-confined air spaces 20 located between the moving diaphragms or diaphragm sections which have air openings 3 and 4 which alternate between the outer edges and the inner edges of the semi-confined air spaces 20 between and proximate adjacent diaphragm assembly layers.

A relatively positive and temporary air pressure zone located proximate the interior of the present invention and inside the loudspeaker cabinet 14, causes sound waves to propagate outward into the listening space from the exterior of the passive radiator device, while a relatively negative and temporary air pressure zone located proximate the interior of the present invention and inside the loudspeaker cabinet 14 causes air to move inward from the listening space and toward the exterior of the passive radiator device. The interior or exterior air openings 3 and 4 respectively of the present passive radiator device may be vented, horn-loaded or otherwise contoured in order to properly handle the sound waves and/or the airflow proximate the inner or outer edges of the device.

In such a way, a low distortion, high sound pressure level capable, external mechanical vibration-free passive radiator device can be achieved with a relatively small form factor, simple construction methods and low cost.

Figure 1A:
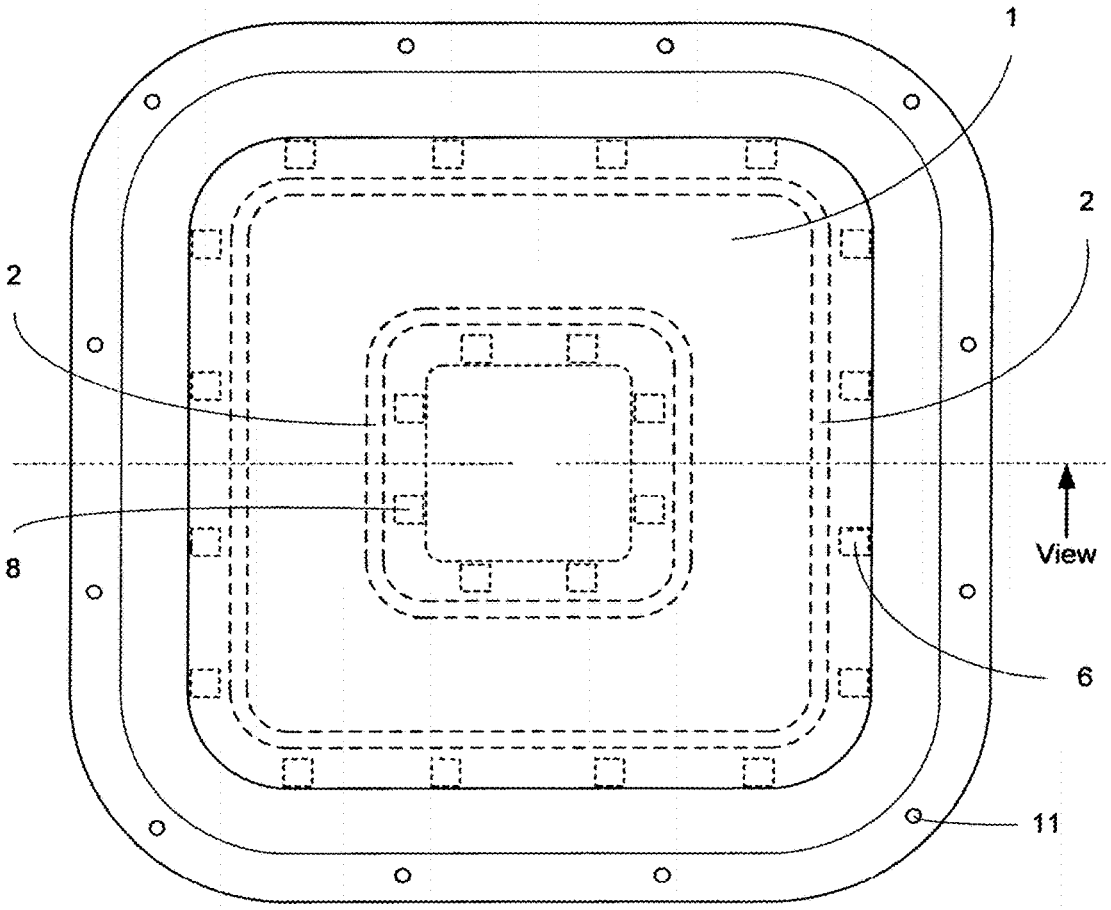
FIG. 1A shows a top see-thru view of a preferred embodiment of the passive radiator device, in a square-shaped form factor.
Figure 1B:
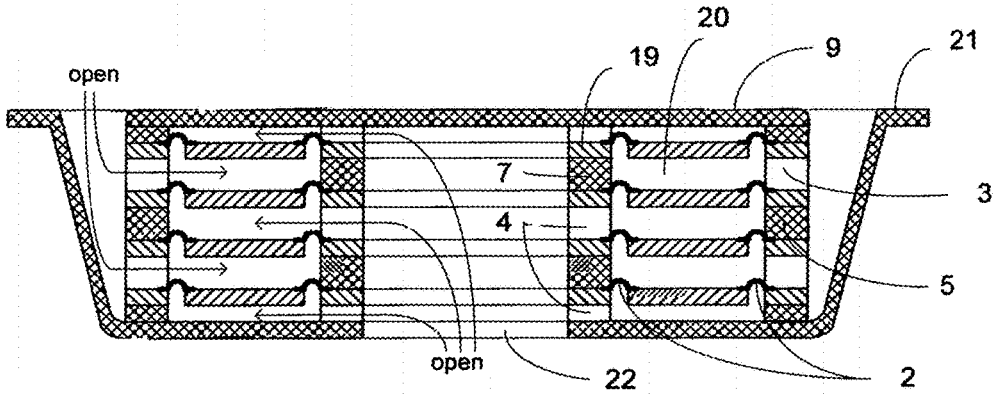
FIG. 1B shows a side cross-section view of the passive radiator device shown in FIG. 1A, with the View cut line as shown in FIG. 1A.
Figure 2:
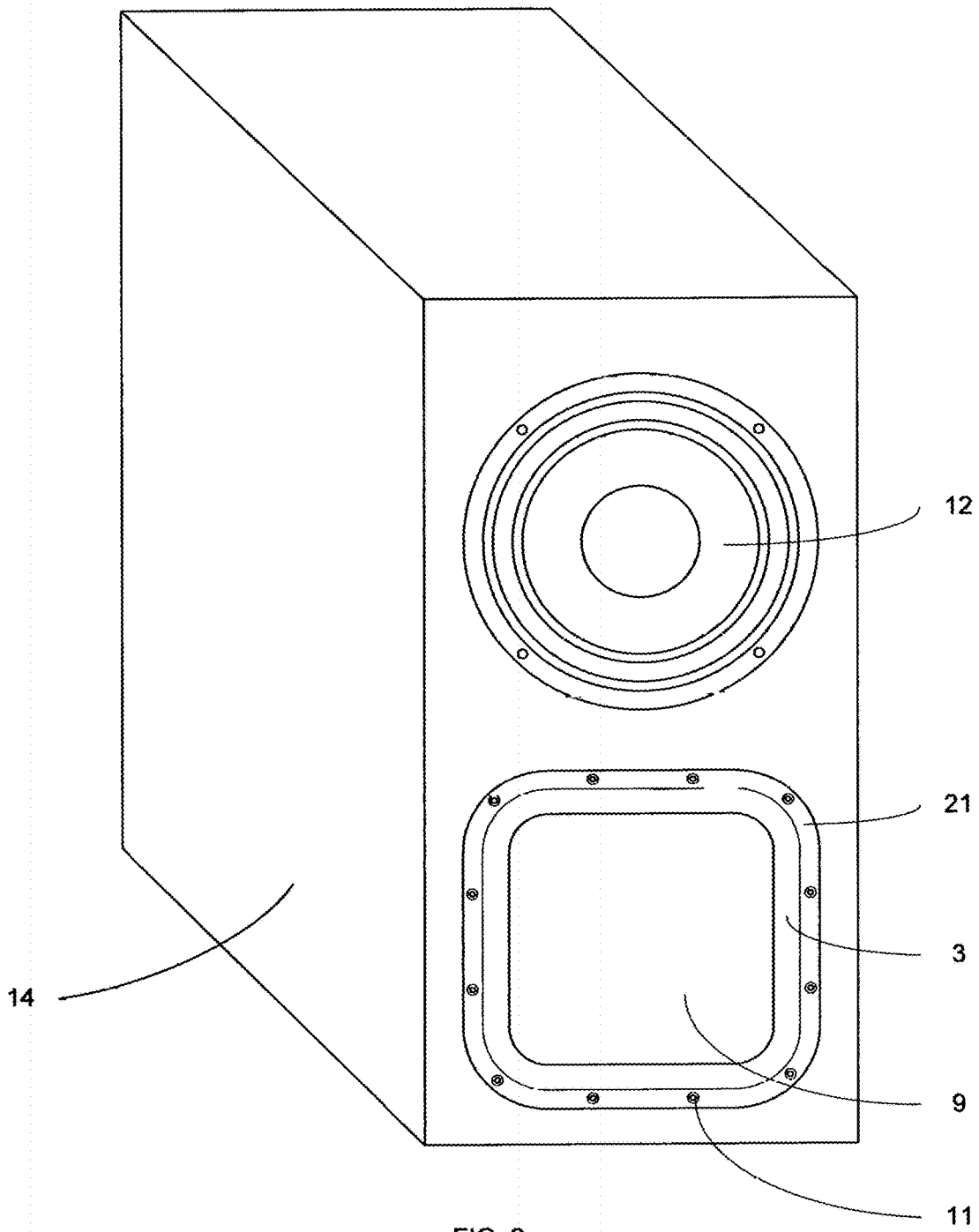
FIG. 2 shows the passive radiator device of FIG. 1 after it has been placed in a hole located on the front area of a traditional loudspeaker enclosure, which also has a conventional moving-coil woofer located in another hole located on the same loudspeaker enclosure.
Figure 3:
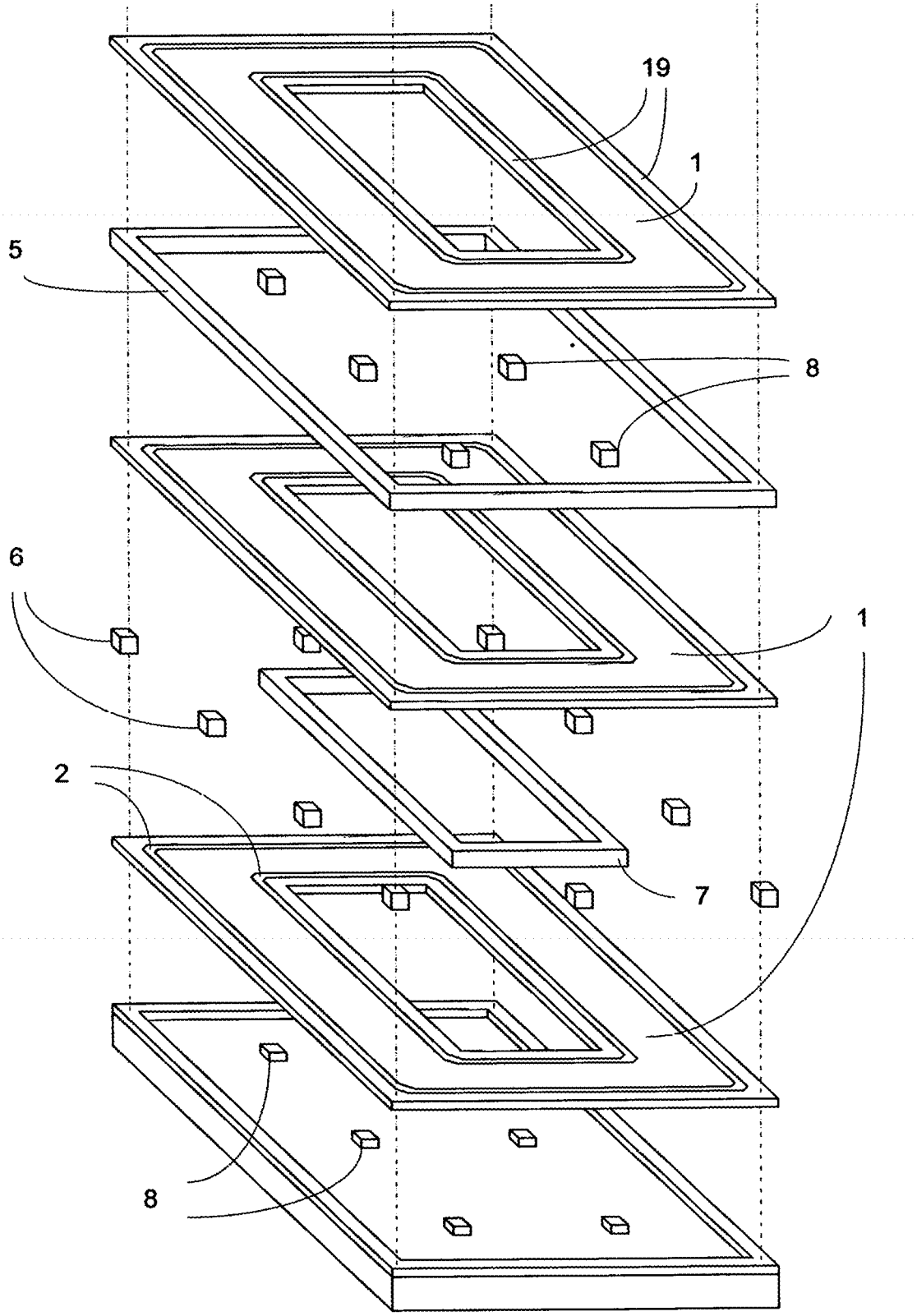
FIG. 3 shows an exploded view of the components of a section of an alternative embodiment of the passive radiator device, which can be mounted proximate, and can replace, one side, a circumference, or an end of a conventional loudspeaker enclosure.

As shown in FIG. 1, FIG. 2 and FIG. 3, a preferred embodiment of the present invention can be mechanically assembled by first creating a plurality of assemblies comprising movable diagram panels 1 which are each surrounded on their inner and outer peripheries by compliant suspension members or surrounds 2, which are then in turn surrounded by inner and outer rigid frames 19.

Located between adjacent, stacked diaphragm panel assemblies are semi-confined airspaces 20 which are either sealed on their inner periphery by an inner wall 7, or sealed on their outer periphery by an outer wall 5, in an alternating manner as shown in FIG. 1 and FIG. 3. Located opposite each inner wall 7 are located a number of outer spacers 6 which provide for outer air openings 3. Likewise, opposite each outer wall 5 are located a number of inner spacers 8 which provide for inner air openings 4.

The desired quantity of diaphragm 1, surround 2 and frame 19 panel assemblies, along with inner walls 7, outer spacers 6, outer walls 5, and inner spacers 8, are stacked and affixed together as shown in FIG. 1 and FIG. 3, and then the resulting stacked assembly is placed between the top cap 9 and the basket 21 as shown in FIG. 1. The basket 21 has a central opening 22 which allows for sound waves to move between the interior of the assembled present invention and the interior of the loudspeaker cabinet 14 on which it is mounted. The means of stacking and/or affixing together the various components of the present invention may include adhesives, screws, bolts, dowels, welding or any other common forms of attachment as generally known to those skilled in the art. Alternatively, part or all of the present invention may be 3-D printed.

The resonant characteristics of the present passive radiator invention may be adjusted by using various suspension compliances, various overall dimensions and various moving masses as needed to achieve the desired resonant frequencies of operation, which are typically somewhere in the bass range of 20 Hz to 100 Hz, and occasionally somewhat higher or lower in frequency. In addition, the air masses located in the semi-confined airspaces 20 may constitute part of the moving mass of the present passive radiator device, along with the diaphragm panels 1 and any other moving masses.

Materials for the diaphragm panels 1, the frames 19, the inner walls 7, the outer walls 5, the inner and outer spacers 6 and 8 respectively, the top cap 9 and the basket 21 may consist of plastic, wood, metal or any other suitable rigid or semi-rigid material as generally known to those skilled in the art. Suitable materials for the compliant suspension surround elements 2 include rubber, foam, plastic or any other flexible material as generally known to those skilled in the art.

As shown in FIG. 2, the outer openings 3 allow for sound waves to propagate to the outside listening environment through the gap defined by the space between the basket 21 and the top cap 9.

Figure 5:
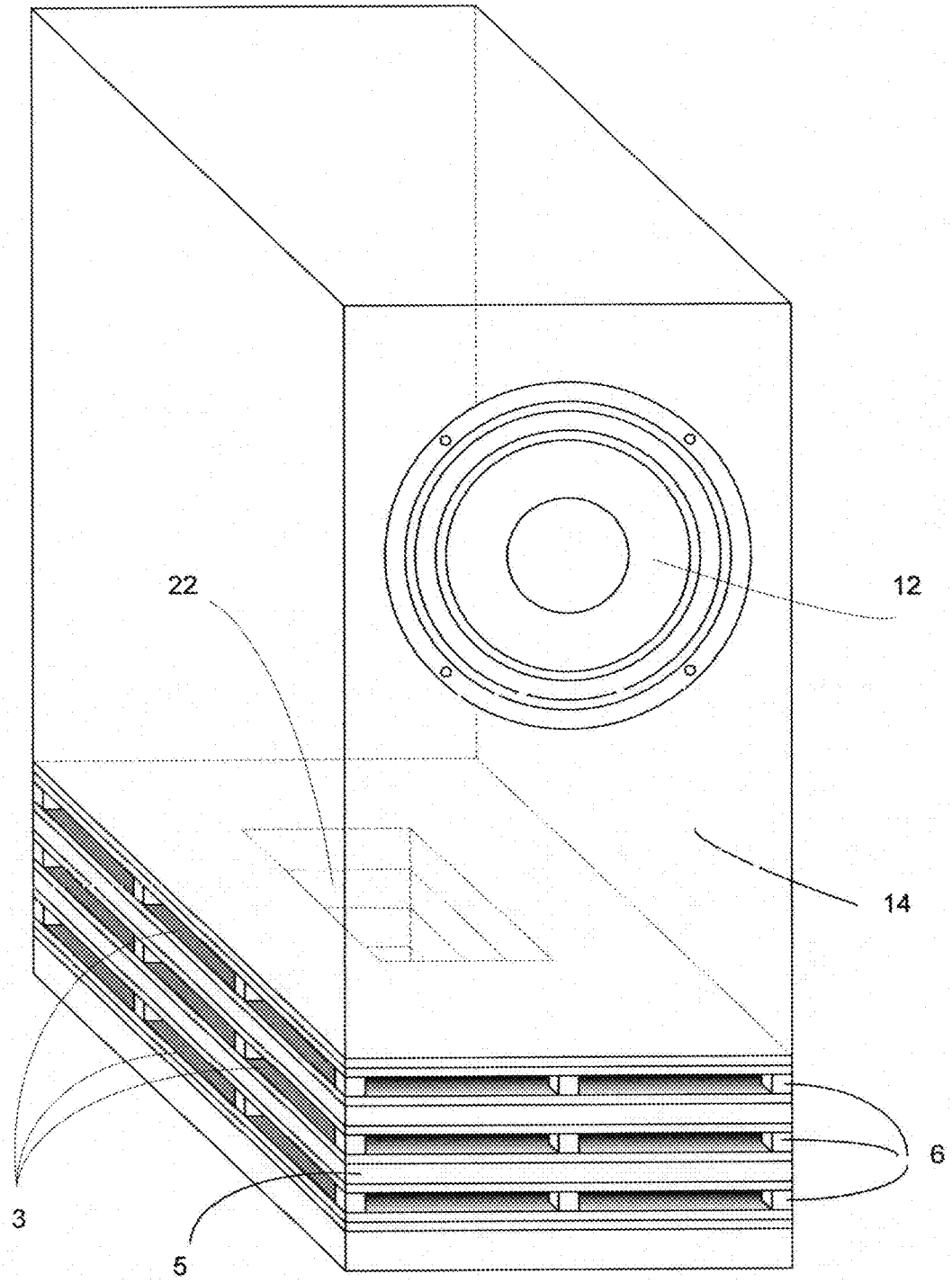
FIG. 5 is a see-thru, external isometric view of a conventional loudspeaker cabinet containing a moving-coil woofer, and also containing the passive radiator device of FIG. 3 located proximate the bottom end of a loudspeaker cabinet.
Figures 6A, 6B, 6C, 6D, 6E:
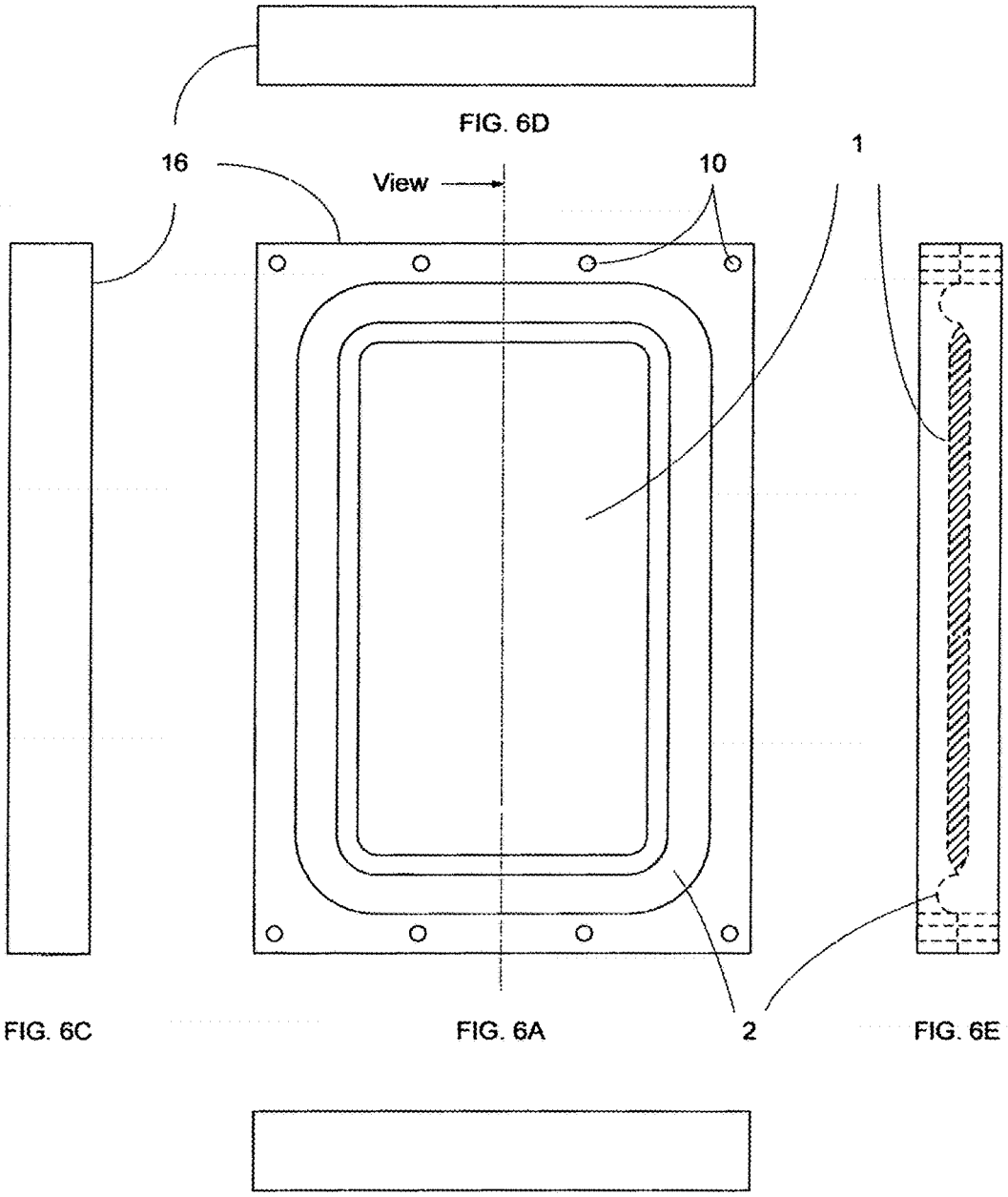
FIG. 6A shows the external front view of a moving diaphragm panel with its associated compliant surround member, located within a rigid outer frame.
FIG. 6B thru 6D are the bottom, left side and right side external views respectively of FIG. 6A.
FIG. 6E is a cross-section view of FIG. 6A
Figures 15A, 15B:
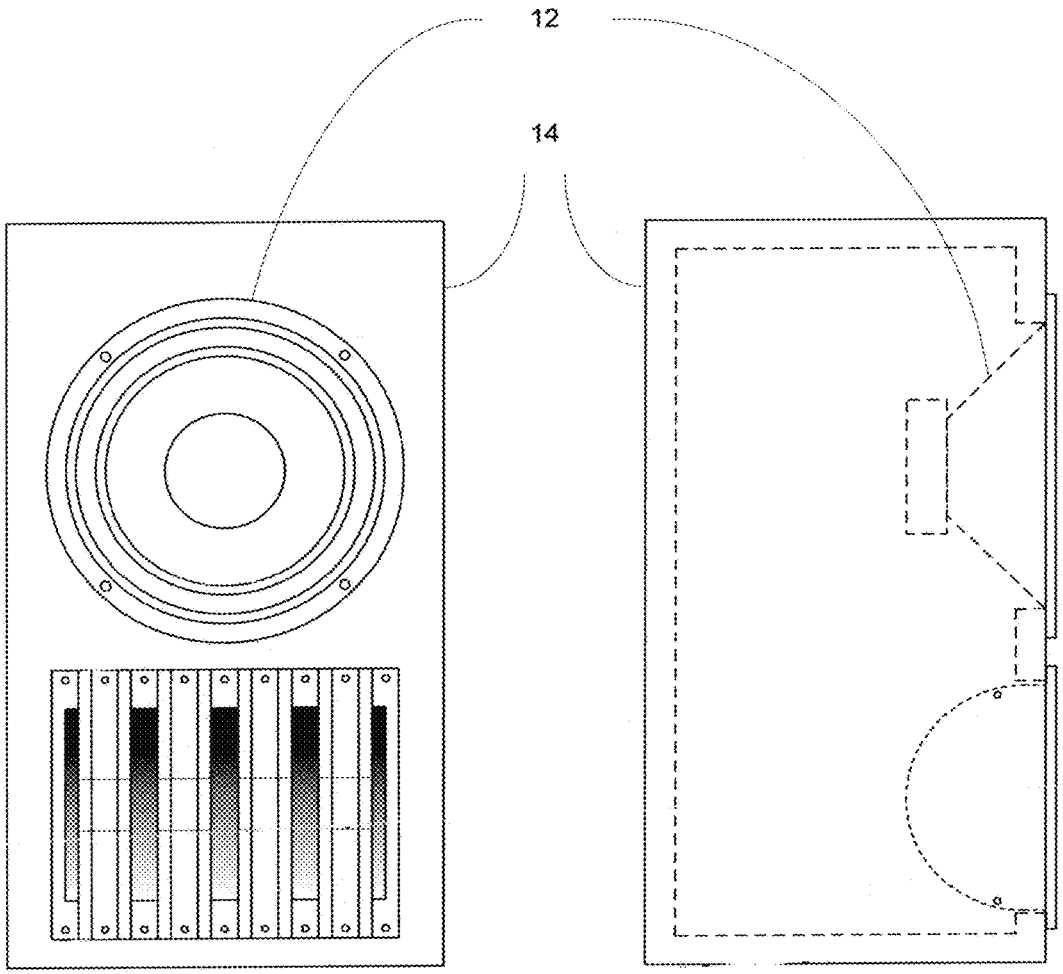
FIG. 15A shows the front external view of the arcuate-shaped passive radiator device of FIG. 13 and FIG. 14 mounted in a hole located on the front panel of a conventional loudspeaker enclosure, with the rear openings of the passive radiator facing forward, and which also has a conventional woofer mounted in another hole in the enclosure.
FIG. 15B shows the side external view of the arcuate-shaped passive radiator device of FIG. 13 and FIG. 14 mounted in a hole located on the front panel of a conventional loudspeaker enclosure, with the rear openings of the passive radiator facing to the right, and which also has a conventional woofer mounted in another hole in the enclosure.
Figures 16A, 16B:
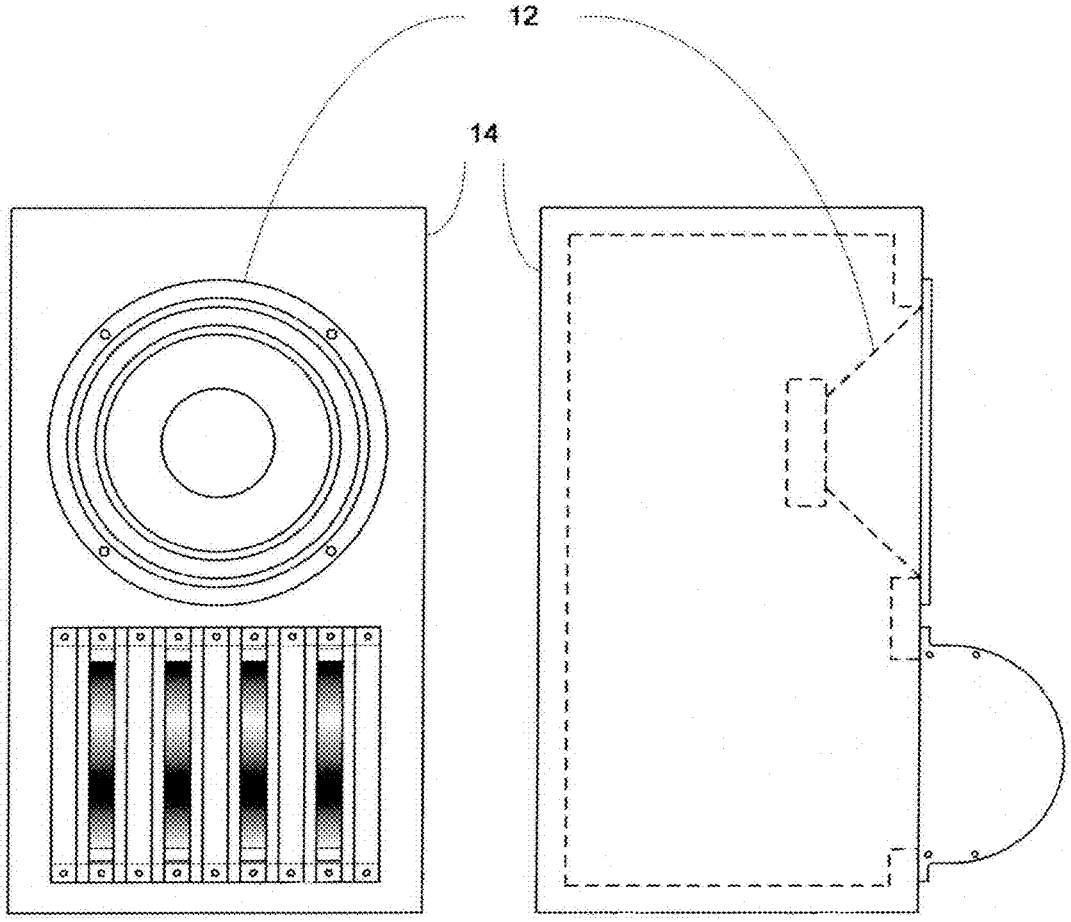
FIG. 16A shows the front external view of the arcuate-shaped passive radiator device of FIG. 13 and FIG. 14 mounted in a hole located on the front panel of a conventional loudspeaker enclosure, with the front openings of the passive radiator facing forward, and which also has a conventional woofer mounted in another hole in the enclosure.
FIG. 16B shows the side external view of the arcuate-shaped passive radiator device of FIG. 13 and FIG. 14 mounted in a hole located on the front panel of a conventional loudspeaker enclosure, with the front openings of the passive radiator facing to the right, and which also has a conventional woofer mounted in another hole in the enclosure.

The mounting of the present invention on the loudspeaker cabinet 14 may be accomplished by placing the basket 21 over a hole located on a panel of the loudspeaker cabinet 14 as shown in FIG. 2, by using screws placed through mounting holes 11, or by other suitable mounting means generally known to those skilled in the art, or alternatively it may comprise one entire side, top, bottom or other surface of a loudspeaker cabinet 14 as shown in FIG. 5. Alternatively, the present invention may be mounted either primarily on the exterior of the cabinet 14 as shown in FIG. 16, or reverse-mounted and primarily located in the interior of a cabinet 14 as shown in FIG. 15.

Figure 4A:
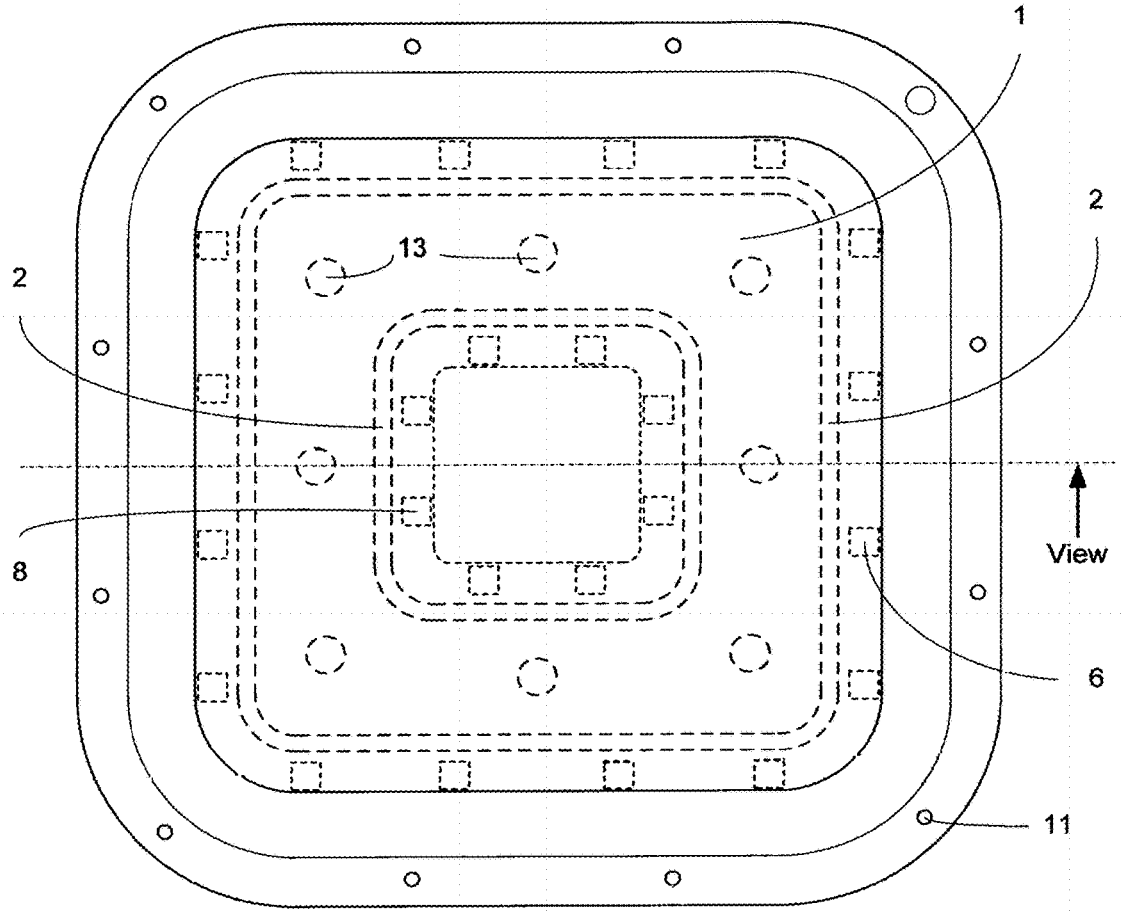
FIG. 4A shows a top see-thru view of an alternative embodiment of the passive radiator device including magnet sections which provide repelling force between the movable diaphragm sections.
Figure 4B:
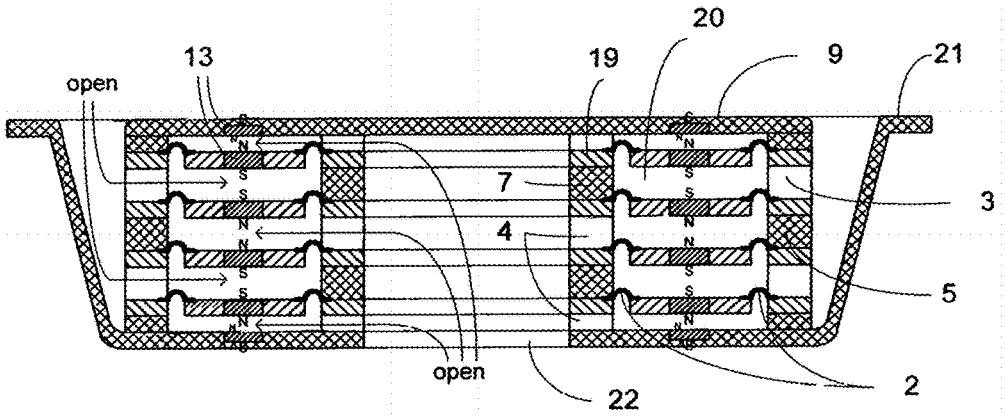
FIG. 4B shows a side cross-section view of the passive radiator device shown in FIG. 4A, with the View cut line as shown in FIG. 4A.

Alternatively, as shown in FIG. 4, multiple magnet elements 13 may be attached to the diaphragm panels 1 and to other nearby surfaces in order to provide some or all of the needed suspension for the diaphragm panels 1, and also to provide for protection against over-excursion of the diaphragm panels 1, with magnetic polarities as shown in FIG. 4. The magnet elements 4 may be permanent magnets or electromagnets, as generally known to those skilled in the art.

The rectangular, closed-loop shape of the diaphragm panels 1 as shown in the preferred embodiment of FIG. 1 may also comprise any other closed-loop shape such as circular, elliptical or polygonal. In addition to closed-loop shapes, the diaphragm panels may alternatively be polygonal as shown in FIG. 6, FIG. 7, FIG. 8 and FIG. 9, and the diaphragm panels may alternatively be arcuate as shown in FIG. 10 through FIG. 16.

Figures 7A, 7B, 7C, 7D, 7E:
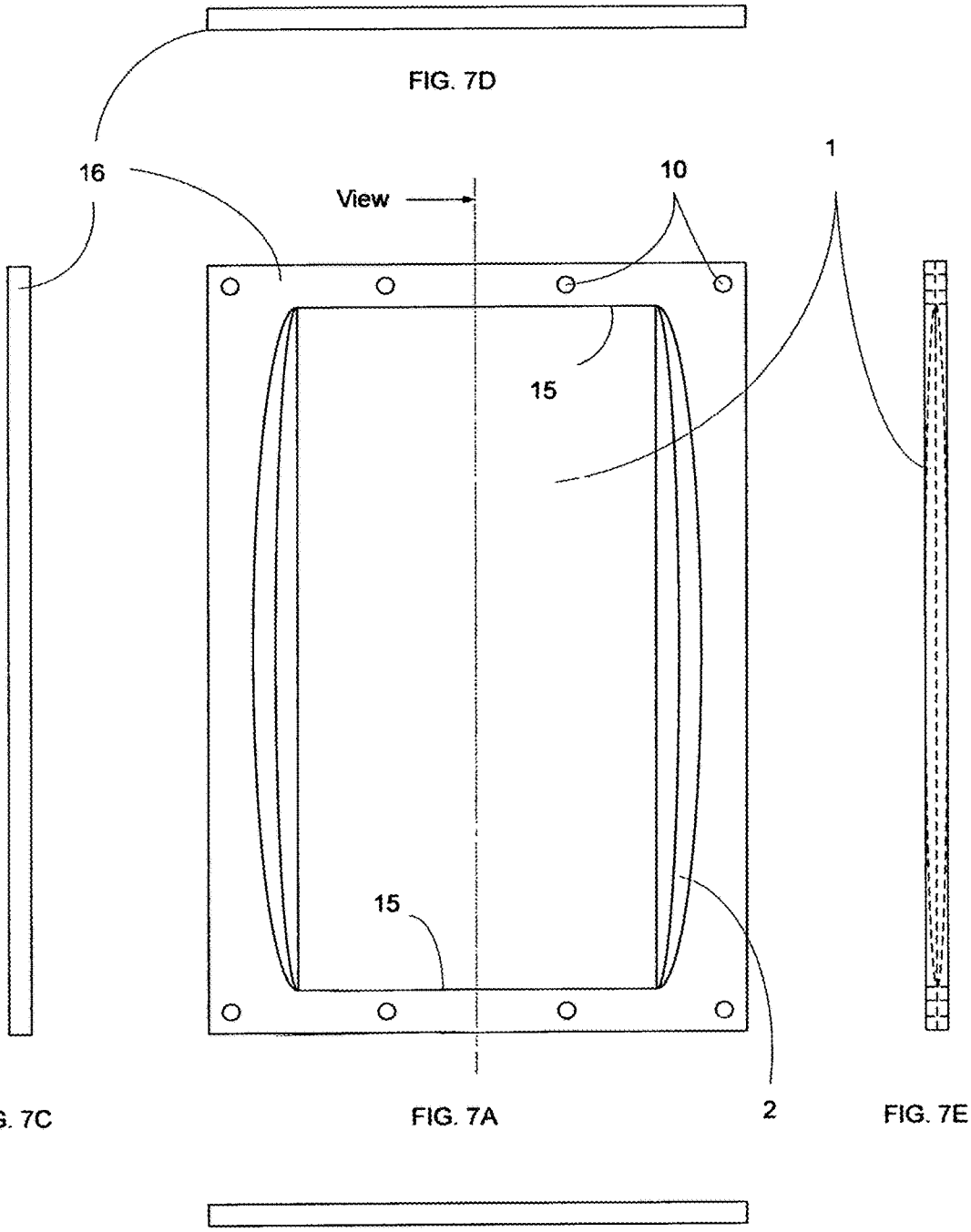
FIG. 7A shows the external front view of a flexible diaphragm panel with its associated compliant surround members and hinged areas, located within a rigid outer frame.
FIG. 7B thru 7D are the bottom, left side and right side external views respectively of FIG. 7A.
FIG. 7E is a cross-section view of FIG. 7A
Figure 9:
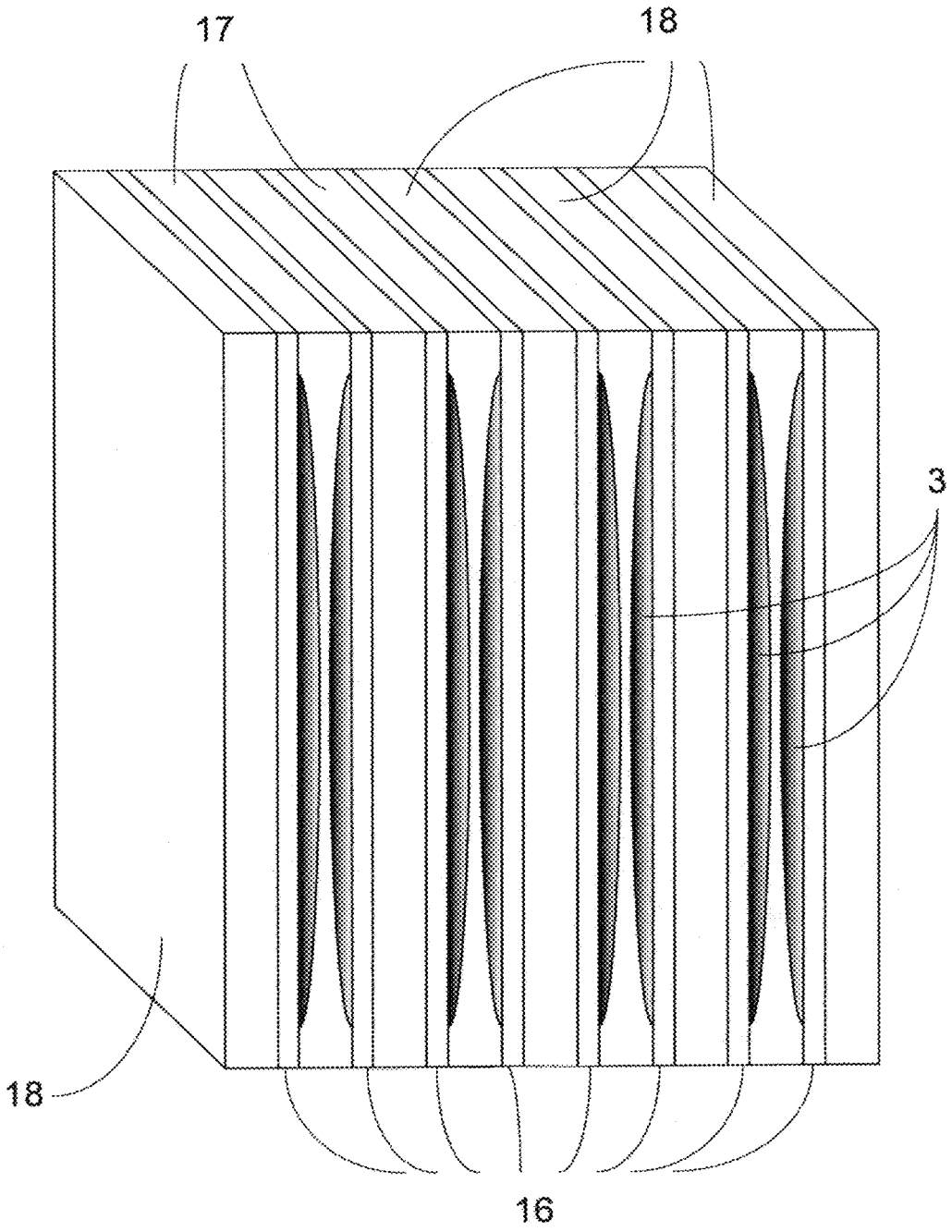
FIG. 9 shows an external isometric view of an alternative embodiment of an assembled passive radiator device consisting of alternating front-facing and rear-facing openings of the separator panels of FIG. 8, interleaved with the diaphragm panels of FIG. 6 or FIG. 7.
Figure 10D:
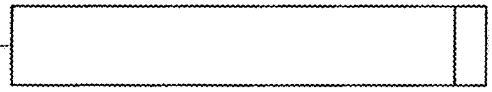
FIG. 10B thru 10D are the bottom, left side and right side external views respectively of FIG. 10A.
Figure 10C:
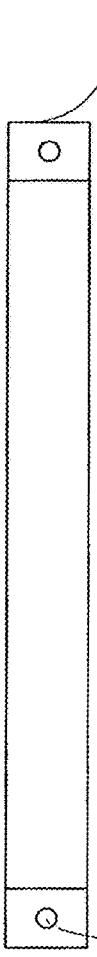
Figure 10A:
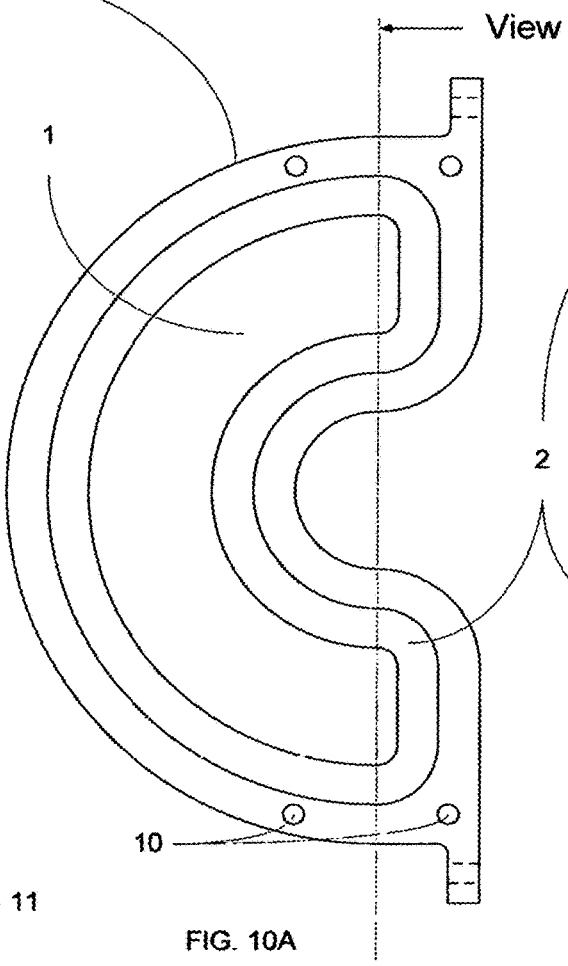
FIG. 10A shows the external front view of an arcuate-shaped moving diaphragm panel with its associated compliant surround member, located within a rigid outer frame, for the alternative assembled passive radiator device shown in FIG. 13 thru FIG. 16.
Figure 10E:
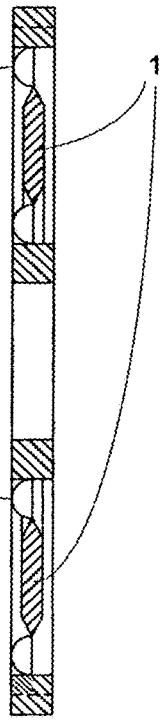
FIG. 10E is a cross-section view of FIG. 10A
Figure 10B:
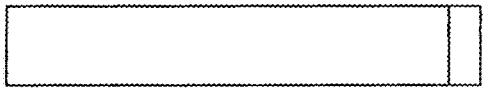
Figure 11D:
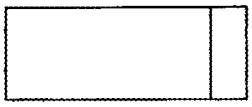
FIG. 11B thru 11E are the bottom, left side, top and right side external views respectively of FIG. 11A.
Figures 11A, 11C, 11E:
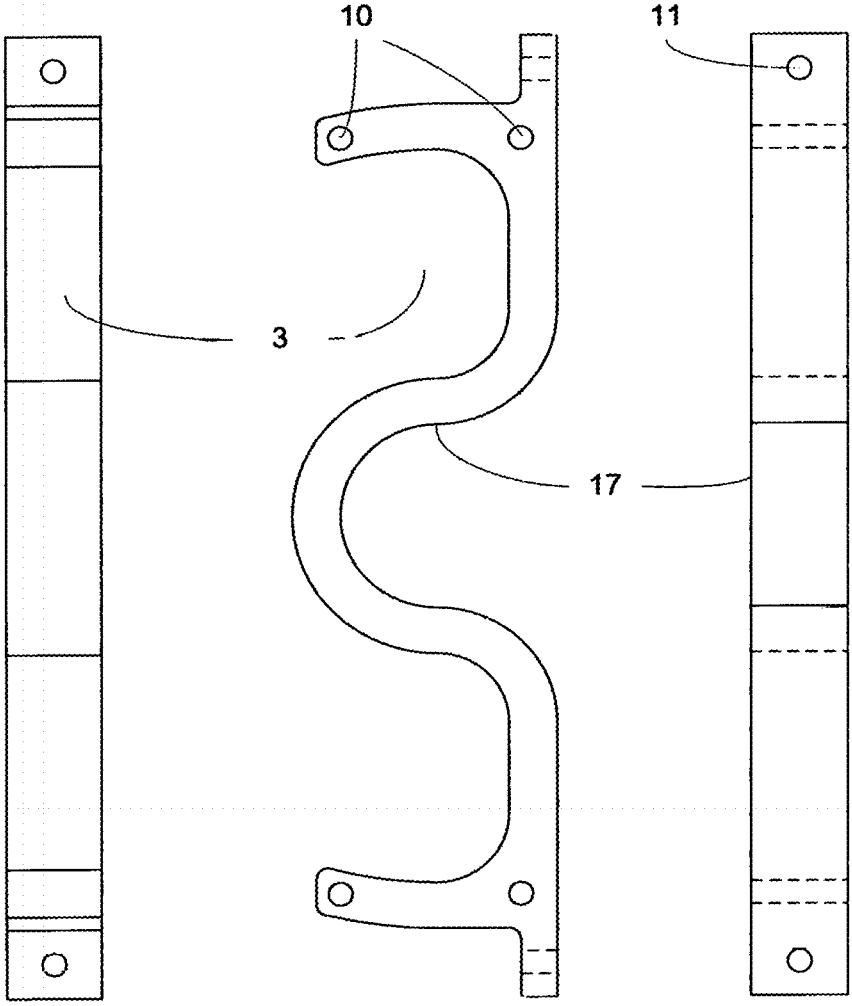
FIG. 11A shows the external view of a front-opening separator member for an arcuate-shaped alternative embodiment of the passive radiator device shown in FIG. 13 thru FIG. 16.
Figure 11B:
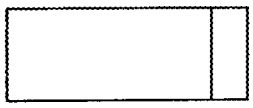
Figure 13C:
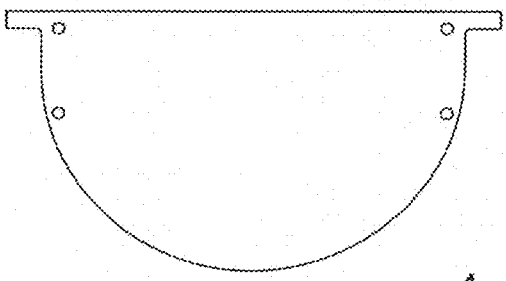
FIG. 13B thru 13D are the bottom, top and right side external views respectively of FIG. 13A.
Figure 13A:
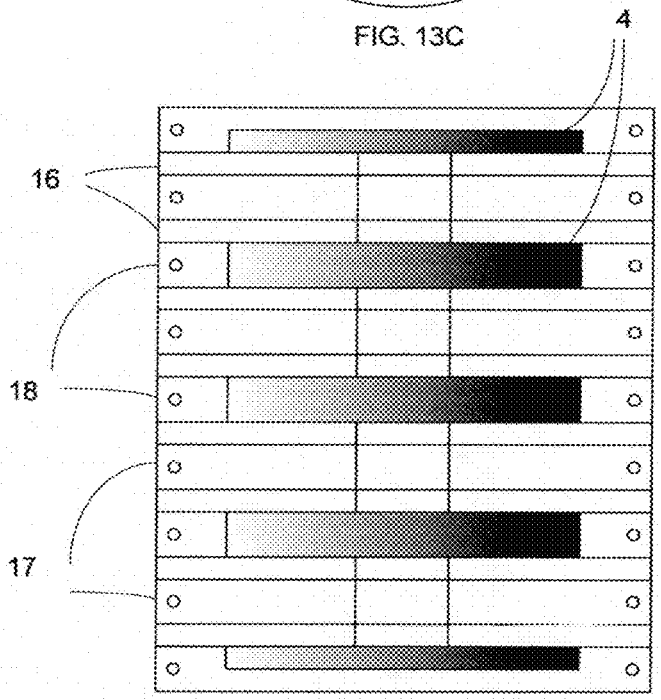
FIG. 13A shows an external rear view of an alternative arcuate-shaped embodiment of an assembled passive radiator device consisting of the alternating front-facing and rear-facing openings of the separator panels of FIG. 11 and FIG. 12, interleaved with the arcuate-shaped diaphragm panels of FIG. 10.
Figure 13D:
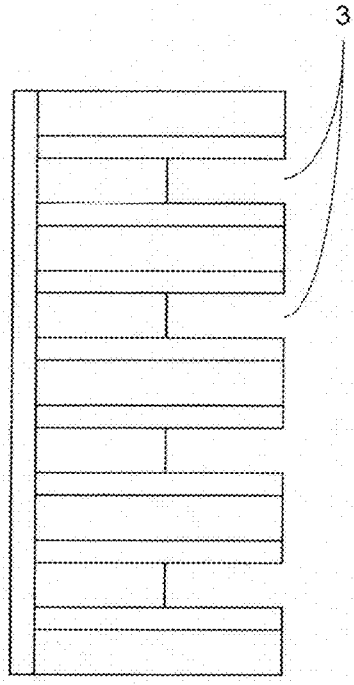
Figure 13B:
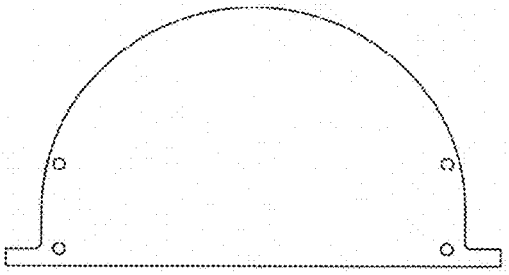
Figure 14C:
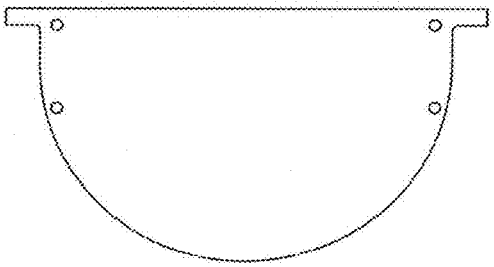
FIG. 14B thru 14D are the bottom, top and right side external views respectively of FIG. 14A.
Figure 14A:
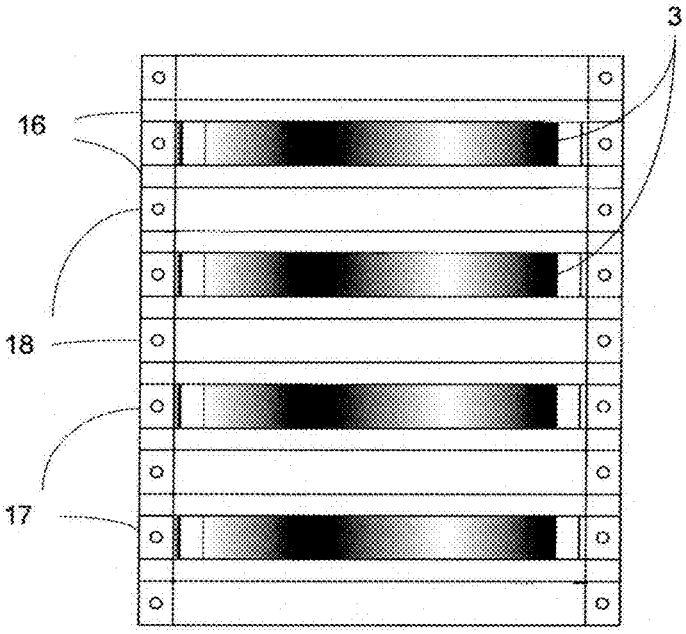
FIG. 14A shows an external front view of an alternative arcuate-shaped embodiment of an assembled passive radiator device consisting of the alternating front-facing and rear-facing openings of the separator panels of FIG. 11 and FIG. 12, interleaved with the arcuate-shaped diaphragm panels of FIG. 10.
Figure 14D:
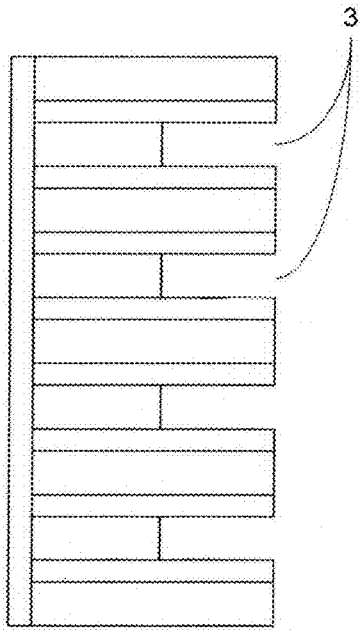
Figure 14B:
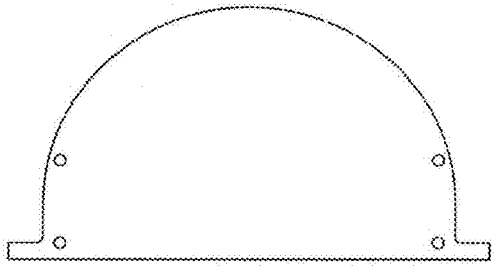

As shown in FIG. 1, FIG. 3, FIG. 6 and FIG. 10, the diaphragm panels 1 may be relatively rigid, or alternatively as shown in FIG. 7 the diaphragm panels 1 may be flexible with hinge areas 15 located at opposite ends of the diaphragm panel 1.

As shown in FIG. 6, FIG. 7, FIG. 8 and FIG. 9, a rectangular embodiment of the present invention may be assembled by interleaving rectangular diaphragm assemblies 16 with forward-facing separator panels 17, which also comprise identical, rearward-facing separator panels 18 created simply by reversing their orientation, and also by using screws, pins, dowels or posts located through alignment holes 10.

Materials for diaphragm panels 1, frames 19, forward-facing separator panels 17 and rearward-facing separator panels 18 may consist of plastic, wood, metal or any other suitable rigid or semi-rigid material as generally known to those skilled in the art. Suitable materials for the flexible diaphragm panels 1 of FIG. 7 include metal, plastic, wood or any other flexible, semi-rigid material as generally known to those skilled in the art.

As shown in FIG. 10 through FIG. 16, an arcuate embodiment of the present invention may be assembled in a similar way by interleaving arcuate diaphragm assemblies 16 with alternating forward-facing, arcuate separator panels 17 and with rearward-facing, arcuate separator panels 18.

By using an even number of moving diaphragm panels 1 in all embodiments of the present invention, any externally transmitted mechanical vibrations will be reduced to a level of nearly zero, which is a vast improvement over conventional passive radiator devices which typically use only one moving panel and which typically transmit large quantities of mechanical vibration onto the cabinet on which they are mounted.

The present invention will provide a greatly improved passive radiator device which has much greater total effective moving surface area and which exhibits much less excursion, with much lower distortion, than a conventional passive radiator device. Also, the present invention can be mounted onto a much smaller cabinet area than that occupied by a conventional passive radiator device.

One additional benefit of the present invention is that the trapped air volumes located inside the semi-confined airspaces 20 which are located on both sides of each diaphragm panel 1, can be utilized as additional moving mass components when calculating the resonant characteristics of the device, further lowering the total device cost since a significant quantity of trapped air inside the present invention is substituted for part of the solid, relatively expensive materials typically constituting the total moving mass in conventional passive radiator designs.

The foregoing description of embodiments have been presented for purposes of illustration and description. It is not exhaustive and it does not limit the claimed inventions to the exact forms disclosed. Additional modifications and variations are possible and may be acquired during further development of the invention.

What is claimed is:

1. A passive acoustic radiator mounted in a loudspeaker enclosure wherein the passive acoustic radiator is driven by air pressure produced by an active acoustic source in the same enclosure, the passive acoustic radiator comprising:

an inlet;

an outlet; and a plurality of stacked diaphragms positioned between the inlet and the outlet, wherein each diaphragm is disposed between a respective inner frame and a respective outer frame, each diaphragm connected to the respective inner frame via an inner suspension member, each diaphragm connected to the respective outer frame via an outer suspension member, each diaphragm spaced apart from at least one other diaphragm, wherein:

a first diaphragm and a second diaphragm are separated by a first semi-confined airspace, the first semi-confined airspace open to the inlet and closed to the outlet; and the second diaphragm and a third diaphragm are separated by a second semi-confined airspace, the second semi-confined airspace closed to the inlet and open to the outlet.

2. The passive acoustic radiator of claim 1, wherein the third diaphragm and a fourth diaphragm are separated by a third semi-confined airspace, the third semi-confined airspace open to the inlet and closed to the outlet.

3. The passive acoustic radiator of claim 2, wherein the fourth diaphragm and a fifth diaphragm are separated by a fourth semi-confined airspace, the fourth semi-confined airspace closed to the inlet and open to the outlet.

4. The passive acoustic radiator of claim 1, wherein the plurality of diaphragms are driven solely by changes in air pressure produced by the active acoustic source.

5. The passive acoustic radiator of claim 1, wherein adjacent diaphragms of the plurality of stacked diaphragms are displaced in opposite directions when driven by changes in air pressure produced by the active acoustic source disposed in the same enclosure.

6. The passive acoustic radiator of claim 1, wherein each diaphragm comprises a continuous, closed-loop shape.

7. The passive acoustic radiator of claim 1, wherein each diaphragm operates in a flexural mode.

8. The passive acoustic radiator of claim 1, wherein the loudspeaker enclosure is a cabinet having an exterior surface, and wherein the passive acoustic radiator is positioned in an opening of the exterior surface.

9. The passive acoustic radiator of claim 1, wherein the loudspeaker enclosure has an interior portion including an upper section and lower section, and wherein the passive acoustic radiator is positioned in the lower section of the interior portion.

10. The passive acoustic radiator of claim 1, wherein the loudspeaker enclosure has an interior portion including an upper section and lower section, and wherein the passive acoustic radiator is positioned in the upper section of the interior portion.

11. The passive acoustic radiator of claim 1, wherein the plurality of stacked diaphragms includes an even number of individual diaphragms.

12. The passive acoustic radiator of claim 1, wherein:

a first magnet is attached to the first diaphragm and a second magnet is attached to the second diaphragm, each of the first magnet and the second magnet having a respective first magnetic pole of a first polarity and a respective second magnetic pole of a second magnetic polarity; and the first magnetic pole of the first magnet is positioned to face the first magnetic pole of the second magnet across the first semi-confined airspace to cause a repelling magnetic force between the first magnet and the second magnet.

13. The passive acoustic radiator of claim 1, wherein the outlet of the passive acoustic radiator comprises a plurality of openings located circumferentially around the loudspeaker enclosure.

* * * * *